US006768460B2

(12) United States Patent
Hoashi et al.

(10) Patent No.: US 6,768,460 B2
(45) Date of Patent: Jul. 27, 2004

(54) DIVERSITY WIRELESS DEVICE AND WIRELESS TERMINAL UNIT

(75) Inventors: Masakazu Hoashi, Fukuoka (JP); Naoki Koga, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 81 days.

(21) Appl. No.: 09/820,077

(22) Filed: Mar. 28, 2001

(65) Prior Publication Data

US 2002/0000938 A1 Jan. 3, 2002

(30) Foreign Application Priority Data

| | | |
|---|---|---|
| Mar. 29, 2000 | (JP) | 2000-090367 |
| Sep. 19, 2000 | (JP) | 2000-283025 |
| Sep. 26, 2000 | (JP) | 2000-292071 |

(51) Int. Cl.[7] ..... H01Q 1/38
(52) U.S. Cl. ..... 343/700 MS; 343/702
(58) Field of Search ..... 343/700 MS, 702, 343/846, 848; H01Q 1/38

(56) References Cited

U.S. PATENT DOCUMENTS

| | | | | |
|---|---|---|---|---|
| 5,771,022 A | * | 6/1998 | Vaughan et al. | 343/702 |
| 6,222,496 B1 | * | 4/2001 | Liu | 343/846 |
| 6,295,030 B1 | * | 9/2001 | Kozakai et al. | 343/700 MS |
| 6,326,924 B1 | * | 12/2001 | Muramoto et al. | 343/702 |
| 6,337,670 B1 | * | 1/2002 | Chen | 343/895 |
| 6,339,402 B1 | * | 1/2002 | McKivergan | 343/702 |

FOREIGN PATENT DOCUMENTS

| | | |
|---|---|---|
| JP | 07131229 | 5/1995 |
| JP | 3041690 | 9/1997 |
| JP | 3004533 | 1/2000 |

* cited by examiner

*Primary Examiner*—Hoanganh Le
(74) *Attorney, Agent, or Firm*—RatnerPrestia

(57) ABSTRACT

A diversity wireless device for use in a wireless terminal unit includes at least one grounded antenna and at least one ungrounded antenna in proximity to each other on a circuit board. By providing at least one ungrounded antenna and at least one ground antenna, there is low correlation between antennas resulting in a high diversity gain. The high diversity gain as a result of these antennas is maintained even with downsizing of the diversity wireless device.

11 Claims, 10 Drawing Sheets

DIVERSITY WIRELESS DEVICE AND WIRELESS TERMINAL UNIT

FIELD OF THE INVENTION

The present invention relates to a diversity wireless device used for wireless communications, and more particularly to a diversity wireless device suitable for use in a wireless terminal unit for a wireless local area network (LAN), such as a wireless PC card.

BACKGROUND OF THE INVENTION

The antenna diversity used for wireless communications and the like is an effective means of eliminating influence of fading from received signals.

Generally, "fading" is a phenomenon in which variation of medium on a radio wave propagation path or the movement of mobile communication equipment through areas with different field intensities changes the strength of received signals rapidly. In addition, "diversity" means ensuring highly-reliable communications by preparing a plurality of antennas and synthesizing or switching two or more signals received at a reception side in a suitable manner when fading deteriorates the receiving condition.

General methods of providing diversity used for wireless communications and the like are as follows. That is, signals are separately received by two or more receiving systems that have a low degree of correlation therebetween and the received signals are synthesized or automatically switched before or after demodulation and then used. Typical examples of such methods include space diversity and polarization diversity.

The space diversity utilizes the fact that the variations caused by the fading at points separated from each other in the vicinity of a receiving point are independent of each other. Generally, two or more antennas are arranged so as to be spatially separated from each other and receive signals separately. Then, the signals are used after being synthesized or switched. The polarization diversity is a method of separately receiving signals using polarized wave receiving antennas that are arranged 90° different from each other. Either method can provide the greater diversity gain when the antennas have the lower degree of correlation therebetween.

FIG. 15 shows a structure of a conventional diversity wireless device (for example, disclosed in Japanese Patent Application Non-Examined Publication No. H07-131229).

In FIG. 15, substrate 3910 has antennas 3930 and 3940 mounted thereon. Formed on substrate 3910 is ground plane 3920. Antenna 3930 has feed terminal 3931 and ground terminal 3932 that also serves to support the antenna. Similarly, antenna 3940 has feed terminal 3941 and ground terminal 3942 that also serves to support the antenna. In addition, mounted on substrate 3910 is radio frequency (RF) circuit 3950. RF circuit 3950 performs such operations as switching transmission/reception antennas, feeding power into the antennas, and processing received signals. The ground of RF circuit 3950 connects to ground plane 3920. In this structure, antennas 3930 and 3940 are so-called inverted F-type antennas, in which ground plane 3920 also affects the antenna characteristics.

In recent years, there has been a strong request for downsizing of wireless devices. The downsizing have necessitated the smaller space assigned to antennas. Therefore, only insufficient space can be provided between antennas.

This makes a higher degree of correlation between the antennas connected to a common ground, thus resulting in reduction in the diversity gains.

In addition, in recent years, with the progress of networking in offices and at home, a plurality of personal computers (hereinafter referred to as PC) is connected via Internet or other networks and LANs are built. On the other hand, networking using wireless devices has been drawing attention because it does not have the problems of troublesome rewiring at a layout change and difficulty in new wiring. Especially, because the Institute of Electrical and Electronics Engineers (IEEE) standardized a transmission speed of 11 Mbps equivalent to that attained with wire devices, the introduction of wireless LANs has been promoted at a cheaper price than ever. An adapter for a wireless LAN is available as a wireless PC card, in which the space its wireless part can occupy is limited. Therefore, the wireless part including its antenna part is structured to have its own features.

Known conventional wireless PC cards include the invention disclosed in Japanese Patent Publication No. 3004533 and the utility model disclosed in Japanese Utility Model Publication No. 3041690, both of which are built with inverted F-type antennas.

FIG. 14A is a perspective view illustrating an appearance of a wireless PC card as a conventional portable wireless terminal unit. FIG. 14B is a perspective view illustrating the antenna arrangement part of the PC card. FIG. 14C is a cross-sectional view of the card including its enclosure taken on line 14C—14C of FIG. 14B.

As shown in FIGS. 14A and 14C, the wireless PC card has extended part 3620 covered with frame 3590, top sheet metal cover 3600, and bottom sheet metal cover 3610. This extended part 3620 includes a plurality of antenna elements therein. In other words, as shown in FIG. 14B, extended part 3620 has conductor section 3510 serving as a first antenna element, conductor section 3520 serving as a second antenna element and ground plane 3580 on circuit board 3570. Conductor section 3510 has feed terminal 3530 and ground terminal 3540 bending at and protruding from the edges of the conductor section. With its terminal 3540 grounded to ground plane 3580 on substrate 3570, the conductor section serves as an inverted F-type antenna. Similarly, conductor section 3520 has feed terminal 3550 and ground terminal 3560 bending at and protruding from the edges of the conductor section. With its terminal 3560 grounded to ground plane 3580, the conductor section serves as an inverted F-type antenna.

Two antenna elements are used for the following reasons: antenna element 3510 and antenna element 3520 provide diversity; and one with better characteristics is selected from these antenna elements by switching them using a switch (not shown) when the variations in intensity of received waves are caused by such influences as fading.

In general, the size of the extended part of a wireless PC card used as a wireless LAN card is determined by the standard of PC cards—54 mm in width, 40 mm in length and 10.5 mm in height. Characterized in that they have high performance and can be downsized, the inverted F-type antennas are often used for a wireless PC card.

Now, the characteristics of the inverted F-type antennas are the better at the greater distance between substrate 3570 and conductor sections 3510 and 3520 (the distance shown at "h" in FIG. 14C). Therefore, it is important to make the distance "h" longer. However, when the distance "h" is determined to the limit of its standard, extended part 3620 is too large as shown in FIG. 14A, thus imposing some limitations on the design of its shape.

SUMMARY OF THE INVENTION

The present invention addresses the above-mentioned problem and aims to provide a diversity wireless device and a wireless terminal unit that can be downsized without reduction in their diversity gains.

A diversity wireless device in accordance with the present invention is structured as a diversity wireless device providing diversity using a plurality of antennas. The device has antennas that are grounded (grounded antennas) and antennas that are not grounded (ungrounded antennas).

Another diversity wireless device in accordance with the present invention is structured as a diversity wireless device providing diversity using a plurality of ungrounded antennas. The device is structured so that a ground is provided in the vicinity of at least one of the ungrounded antennas and the ungrounded antenna is coupled to the ground via high-frequency waves.

Still another diversity wireless device in accordance with the present invention is structured as a diversity wireless device providing diversity using a plurality of antennas. The device is structured so that it has at least one ungrounded antenna and a ground partly surrounding the ungrounded antenna and that the ungrounded antenna and the ground are coupled to each other via high-frequency waves.

These structures allow downsizing of the devices without reducing their diversity gains.

A wireless terminal unit in accordance with the present invention is structured as a wireless terminal unit having an antenna element. The terminal unit is structured so that the antenna element includes:

(a) a substrate;

(b) a first conductor section substantially parallel to the substrate; and (c) a second conductor section successively formed from the first conductor section and angularly arranged relative to said substrate.

This structure allows a change in the height of the antenna element part, thus offering an advantage of reducing limitations on the design of the antenna part.

DETAILED DESCRIPTION OF THE INVENTION

Exemplary embodiments of the present invention are hereinafter demonstrated with reference to the accompanying drawings.

(First Embodiment)

Figure 1:
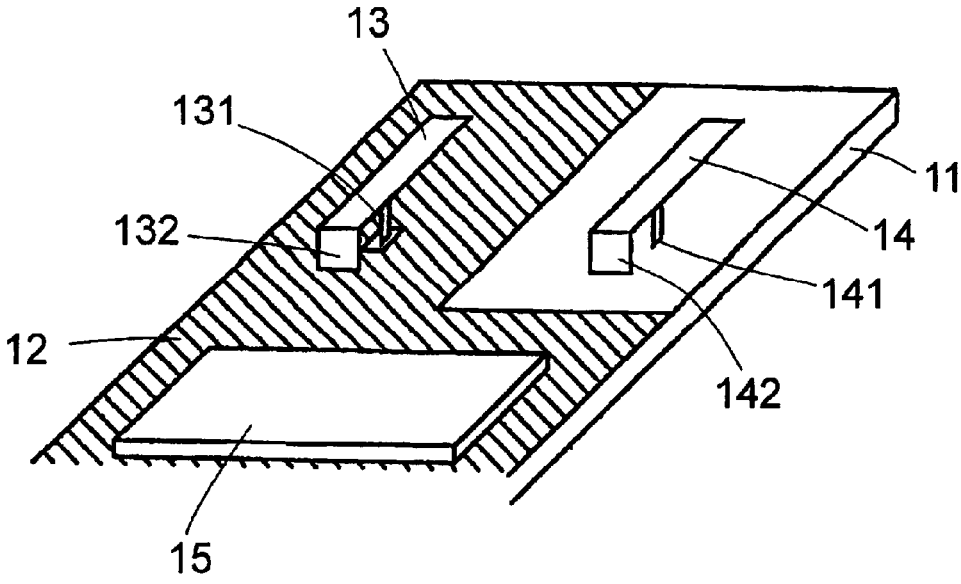
FIG. 1 shows a structure of a diversity wireless device in accordance with a first exemplary embodiment of the present invention.
Figure 10:
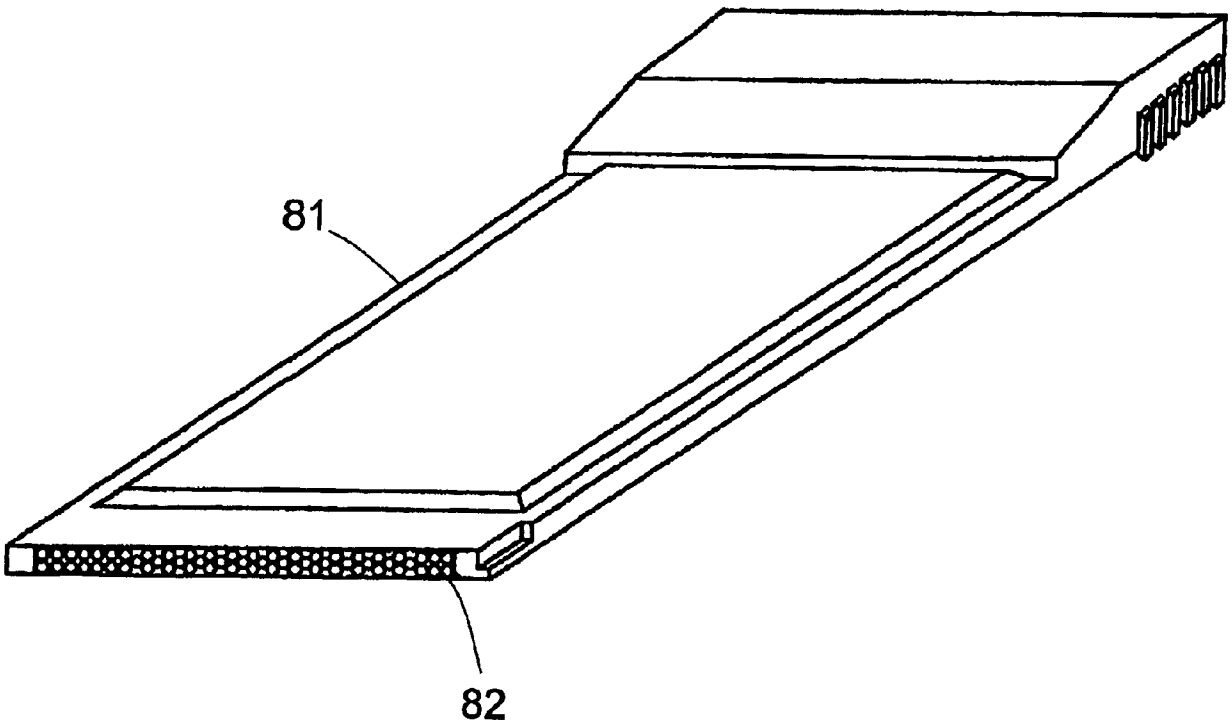
FIG. 10 is a sketch drawing of the diversity wireless device in accordance with the first embodiment of the present invention.

FIG. 1 shows a structure of a diversity wireless device in accordance with the first embodiment of the present invention and FIG. 10 is a sketch drawing of the same device.

As shown in FIG. 10, diversity wireless device 81 is of a PC card type and has connector part 82 for insertion into a PC card slot (not shown) and connection thereto. The device 81 is connected to such networking equipment as a gateway unit that has a PC card slot, a portable PC, or the like, and used for wireless data transmission/reception.

Next, the internal structure of device 81 is described with reference to FIG. 1.

In FIG. 1, substrate 11 has an antenna 13 that is grounded (grounded antenna) and an antenna 14 that is not grounded (ungrounded antenna) mounted thereon. Formed on substrate 11 is ground plane 12. Grounded antenna 13 has feed terminal 131 and ground terminal 132. This ground terminal 132 supports antenna 13, and moreover, electrically connects it to ground plane 12. Ungrounded antenna 14 has feed terminal 141 and support terminal 142 for supporting antenna 14. This support terminal 142 is not grounded. Substrate 11 also has RF circuit 15 mounted thereon. The ground of RF circuit 15 connects to ground plane 12. RF circuit 15 switches transmission/reception antennas, feeds power into the antennas, and processes received signals.

In this structure, antenna 13 is a so-called inverted F-type antenna, in which ground plane 12 also affects the antenna characteristics. On the other hand, antenna 14 is completely isolated from antenna 13 and ground plane 12. Therefore, antennas 13 and 14 have a low degree of correlation therebetween and providing diversity using these antennas gives a high diversity gain.

(Second Embodiment)

Figure 2:
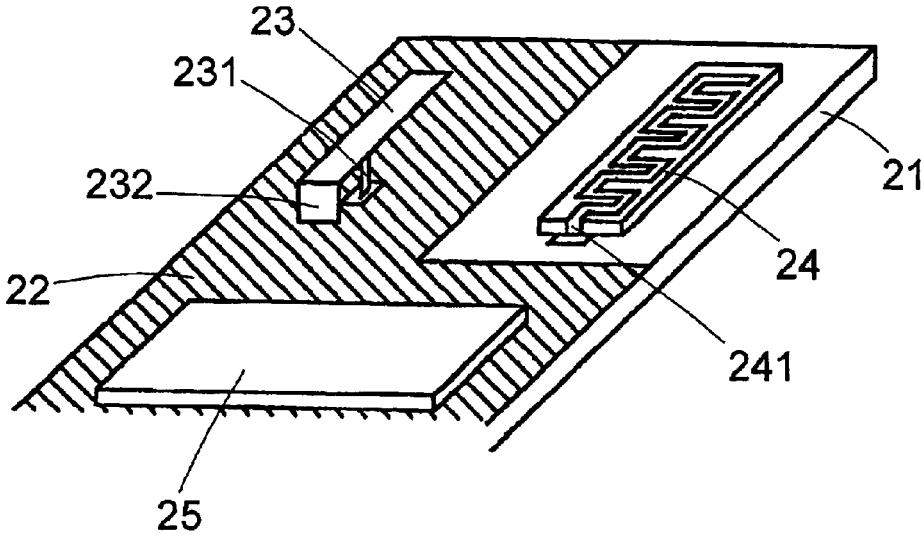
FIG. 2 shows a structure of a diversity wireless device in accordance with a second exemplary embodiment of the present invention.

FIG. 2 shows a structure of a diversity wireless device in accordance with the second embodiment of the present invention.

In FIG. 2, substrate 21 has grounded antenna 23 and ungrounded antenna 24 mounted thereon. Formed on substrate 21 is ground plane 22. Antenna 23 has feed terminal 231 and ground terminal 232. This ground terminal 232 supports antenna 23, and moreover, electrically connects it to ground plane 22. Antenna 24 has feed terminal 241. Substrate 21 also has RF circuit 25 mounted thereon. The ground of RF circuit 25 connects to ground plane 22. RF circuit 25 switches transmission/reception antennas, feeds power into the antennas, and processes received signals.

In this second embodiment, an antenna with a meander pattern formed on a separate substrate is used as ungrounded antenna 24 instead of ungrounded antenna 14 of the first embodiment in FIG. 1.

Using an antenna of a different structure in this manner can make a low degree of correlation between antennas 23 and 24, thus giving a diversity effect utilizing the advantage of each antenna. The pattern of meander antenna may be formed directly on substrate 21.

When diversity is provided using two antennas 23 and 24, the device of this second embodiment can attain a high diversity gain similar to that attained with the device of the first embodiment.

(Third Embodiment)

Figure 3:
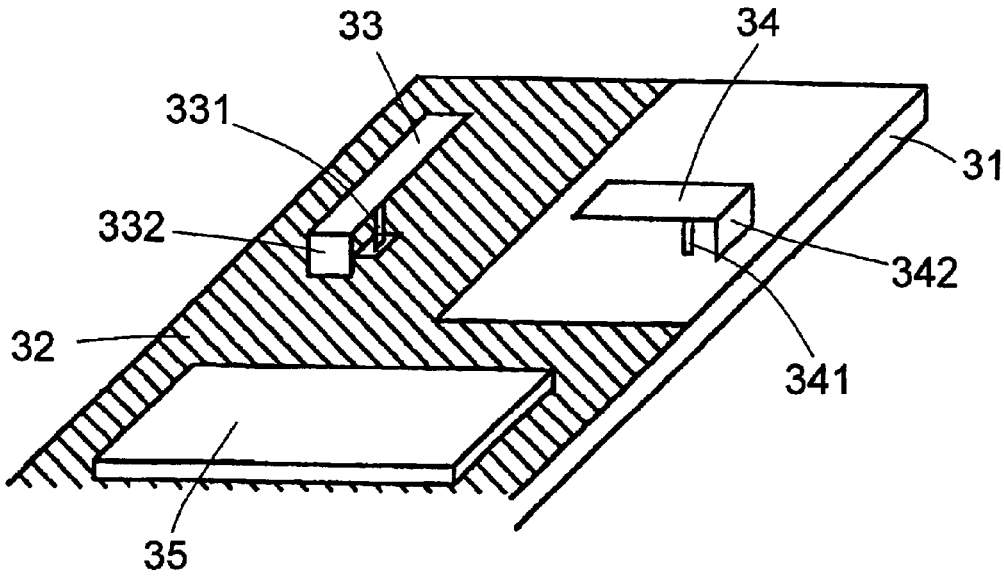
FIG. 3 shows a structure of a diversity wireless device in accordance with a third exemplary embodiment of the present invention.

FIG. 3 shows a structure of a diversity wireless device in accordance with the third embodiment of the present invention.

In FIG. 3, substrate 31 has grounded antenna 33 and ungrounded antenna 34 mounted thereon. Formed on substrate 31 is ground plane 32. Antenna 33 has feed terminal 331 and ground terminal 332. This ground terminal 332 supports antenna 33, and moreover, electrically connects it to ground plane 32. Antenna 34 has feed terminal 341 and support terminal 342 for supporting antenna 34. This terminal 342 is not grounded. Substrate 31 also has RF circuit 35 mounted thereon. The ground of RF circuit 35 connects to ground plane 32. RF circuit 35 switches transmission/reception antennas, feeds power into the antennas, and processes received signals.

In the above structure, setting the angle between antennas 33 and 34 to a predetermined value, e.g. 90°, can make a low degree of correlation therebetween and can also give a polarization diversity effect. This provides a diversity wireless device having a great diversity gain.

(Fourth Embodiment)

Figure 4:
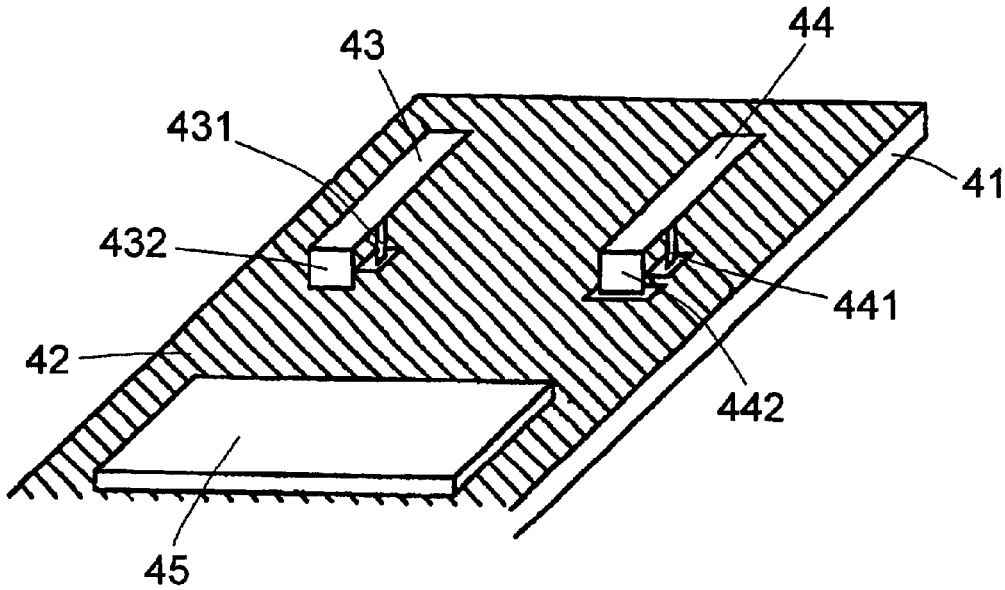
FIG. 4 shows a structure of a diversity wireless device in accordance with a fourth exemplary embodiment of the present invention.

FIG. 4 shows a structure of a diversity wireless device in accordance with the fourth embodiment of the present invention.

In FIG. 4, substrate 41 has grounded antenna 43 and an ungrounded antenna 44 mounted thereon. Formed on substrate 41 is ground plane 42. Antenna 43 has feed terminal 431 and ground terminal 432. This ground terminal 432 supports antenna 43, and moreover, electrically connects it to ground plane 42. Antenna 44 has feed terminal 441 and support terminal 442 for supporting antenna 44. This terminal 442 is not grounded. Substrate 41 also has RF circuit 45 mounted thereon. The ground of RF circuit 45 connects to ground plane 42. RF circuit 45 switches transmission/reception antennas, feeds power into the antennas, and processes received signals.

In the fourth embodiment, ground plane 42 is disposed in close proximity to supporting terminal 442 so as to couple antenna 44 to the ground via high-frequency waves.

As shown in the above-mentioned structure, ground plane 42 is disposed in close proximity to antenna 44 and the antenna is coupled to the ground via high-frequency waves. This allows antenna 44 to have wider directivity and maintains a low degree of correlation between the both antennas, thus providing a diversity wireless device with a greater diversity gain.

In the fourth embodiment, the coupling via high-frequency waves is performed between ground plane 42 formed on the front layer of substrate 41 as shown in FIG. 4 and the both antennas. Such coupling, however, can also be performed between ground plane 42 formed on the inner layer or back layer of substrate 41 and the both antennas.

(Fifth Embodiment)

Figure 5:
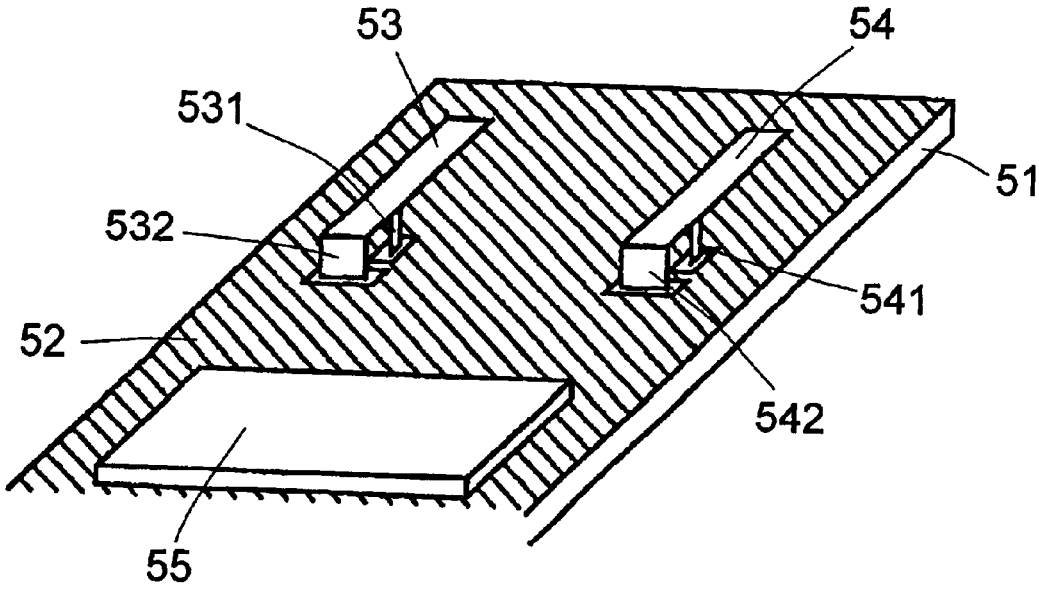
FIG. 5 shows a structure of a diversity wireless device in accordance with a fifth exemplary embodiment of the present invention.

FIG. 5 shows a structure of a diversity wireless device in accordance with the fifth embodiment of the present invention.

In FIG. 5, substrate 51 has two ungrounded antennas 53 and 54 mounted thereon. Formed on substrate 51 is ground plane 52. Antenna 53 has feed terminal 531 and support terminal 532 for supporting antenna 53. This terminal 532 is not grounded. Antenna 54 has feed terminal 541 and support terminal 542 for supporting antenna 54. This terminal 542 is not grounded. Substrate 51 also has RF circuit 55 mounted thereon. The ground of RF circuit 55 connects to ground plane 52. RF circuit 55 switches transmission/reception antennas, feeds power into the antennas, and processes received signals.

In the fifth embodiment, ground plane 52 is disposed in close proximity to terminals 532 and 542 so as to couple the both antennas to the ground via high-frequency waves.

As shown in the above-mentioned structure, ground plane 52 is disposed in close proximity to antennas 53 and 54 and the both antennas are coupled to the ground via high-frequency waves. This allows the both antennas to have wider directivity while maintaining a low degree of correlation between the both antennas, thus giving an effect of excellent space diversity.

Moreover, when the angle between the both antennas is set to 90° so that one essentially receives signals in a horizontally polarized wave surface and the other essentially receives signals in a vertically polarized wave surface, an effect of polarization diversity can also be obtained.

In the fifth embodiment, the coupling via high-frequency waves is performed between ground plane 52 formed on the front layer of substrate 51 as shown FIG. 5 and the both antennas. Such coupling, however, can also be performed between ground plane 52 formed on the inner layer or back layer of substrate 51 and the both antennas.

(Sixth Embodiment)

Figure 6:
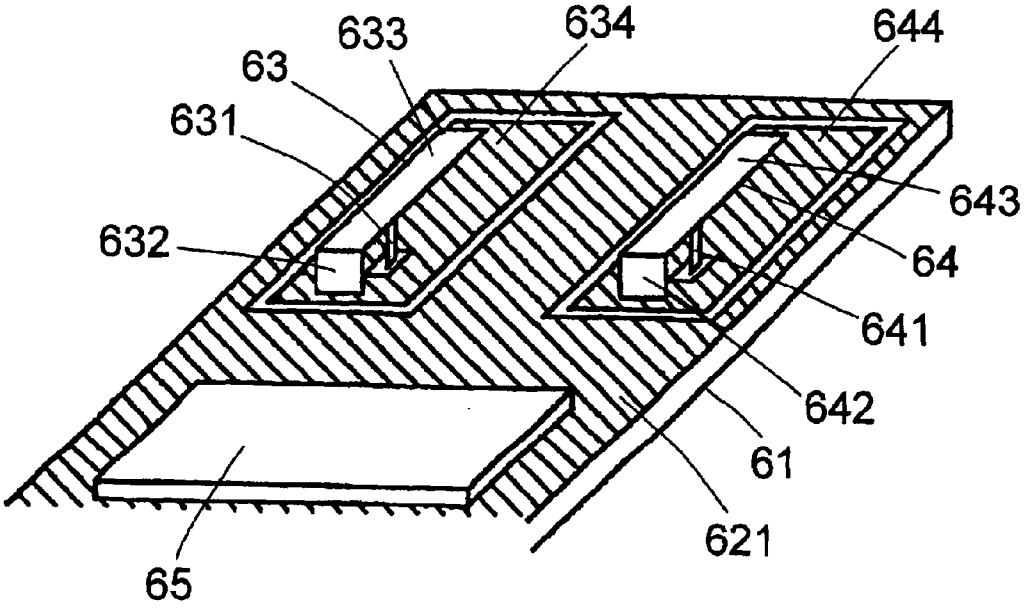
FIG. 6 shows a structure of a diversity wireless device in accordance with a sixth exemplary embodiment of the present invention.
Figure 7:
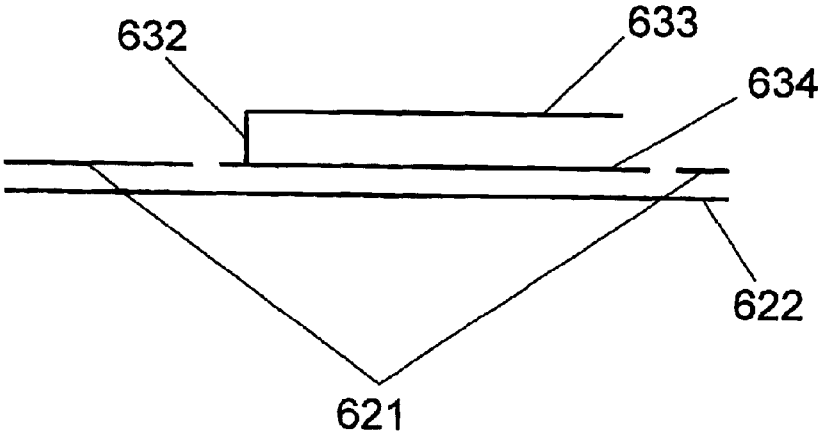
FIG. 7 is a cross-sectional view of the antenna part of the same device in FIG. 6.

FIG. 6 shows a structure of a diversity wireless device in accordance with the sixth embodiment of the present invention and FIG. 7 is a cross-sectional view of the antenna part of the same device.

In FIG. 6, substrate 61 has two ungrounded antennas 63 and 64 mounted thereon. Formed on substrate 61 is ground plane 621 and island-like conductors 634 and 644 surrounded by this ground plane 621. Antenna 63 has feed terminal 631 and support terminal 632 for supporting antenna 63. This terminal 632 is connected to conductor 634 but ungrounded. Similarly, antenna 64 has feed terminal 641 and support terminal 642 for supporting antenna 64. This terminal 642 is connected to conductor 644 but ungrounded. Substrate 61 also has RF circuit 65 mounted thereon. The ground of RF circuit 65 connects to ground plane 621. RF circuit 65 switches transmission/reception antennas, feeds power into the antennas, and processes received signals.

In the sixth embodiment, as shown in FIG. 7, substrate 61 is composed of a multi-layer substrate. Formed on the first layer of substrate 61 is ground plane 621. Formed on the second layer of substrate 61 is ground plane 622. Now, support terminal 632 made of a conductive member connects conductors 633 and 634. Similarly, support terminal 642 made of a conductive member connects conductors 643 and 644. The ground of RF circuit 65 is connected to ground planes 621 and 622 directly or via thorough holes, and the like.

In accordance with the sixth embodiment, conductors 634 and 644, a part of the each antenna, are coupled to ground planes 621 and 622 via high-frequency waves. This allows the both antennas to have wider directivity while maintaining a lower correlation between the both antennas, thus giving an effect of excellent space diversity.

Moreover, when the angle between the both antennas is set to 90° so that one essentially receives signals in a horizontally polarized wave surface and the other essentially receives signals in a vertically polarized wave surface, an effect of polarization diversity can also be obtained.

In the sixth embodiment, conductors 633 and 643 are arranged in parallel to substrate 61. However, the present invention is not necessarily limited to this arrangement. Furthermore, conductors 634 and 644 are not necessarily formed on substrate 61 and may be formed on the antenna side. Although both antennas 63 and 64 are ungrounded in this embodiment, the device may be structured to have one grounded antenna.

(Seventh Embodiment)

Figure 8:
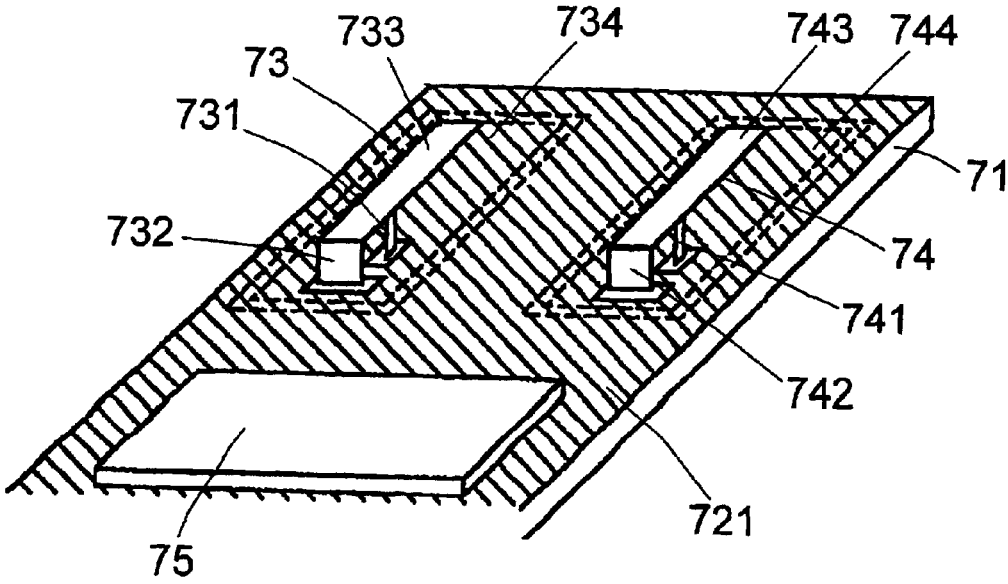
FIG. 8 shows a structure of a diversity wireless device in accordance with a seventh exemplary embodiment of the present invention.
Figure 9:
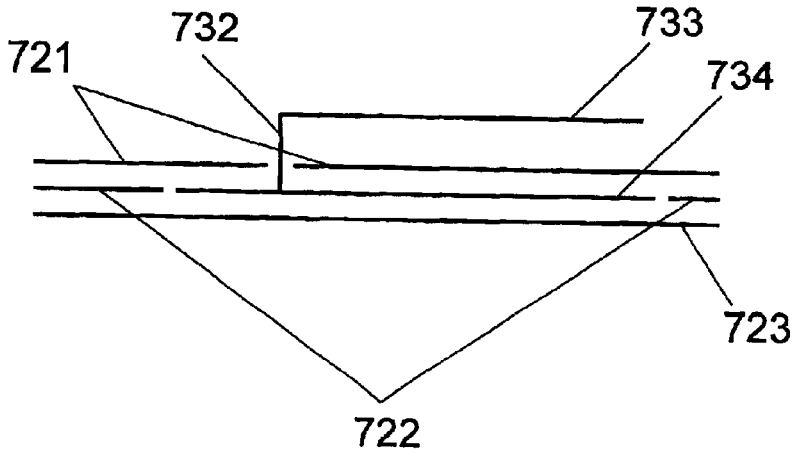
FIG. 9 is a cross-sectional view of the antenna part of the same device in FIG. 8.

FIG. 8 shows a structure of a diversity wireless device in accordance with the seventh embodiment of the present invention and FIG. 9 is a cross-sectional view of the antenna part of the same device.

In FIG. 8, substrate 71 has two ungrounded antennas 73 and 74 mounted thereon. In the seventh embodiment, as shown in FIG. 9, substrate 71 is composed of a multi-layer substrate. Formed on the first layer of substrate 71 is ground plane 721. Formed on the second layer of substrate 71 is ground plane 722 and island-like conductors 734 and 744, each surrounded by this ground plane 722. Formed on the third layer of substrate 71 is ground plane 723.

Antenna 73 has feed terminal 731 and support terminal 732 for supporting antenna 73. This terminal 732 is connected to conductor 734 but ungrounded. Similarly, antenna 74 has feed terminal 741 and support terminal 742 for supporting antenna 74. This terminal 742 is connected to conductor 744 but ungrounded. Substrate 71 also has RF circuit 75 mounted thereon. The ground of RF circuit 75 connects to ground plane 721. RF circuit 75 switches transmission/reception antennas, feeds power into the antennas, and processes received signals.

In the seventh embodiment, antenna 73 is composed of feed terminal 731, support terminal 732 made of a conductive member, conductor 733 formed in parallel to substrate 71, and conductor 734 formed on the second layer of substrate 71. Support terminal 732 connects conductors 733 and 734. Similarly, antenna 74 is composed of feed terminal 741, support terminal 742 made of a conductive member, conductor 743 formed in parallel to substrate 71, and conductor 744 formed on the second layer of substrate 71. Support terminal 742 connects conductors 743 and 744. Thus, each of conductors 734 and 744 is surrounded by ground plane 721 on its top face, by ground plane 722 on its side faces and by ground plane 723 on its bottom face. In other words, the conductors are surrounded by ground planes three-dimensionally. The ground of RF circuit 75 is connected to each of ground planes 721, 722 and 723 directly or via thorough holes, and the like.

In accordance with the seventh embodiment shown above, conductors 734 and 744, a part of the antennas, are coupled to each of ground planes 721, 722 and 723 via high-frequency waves. This allows the both antennas to have wider directivity while maintaining a low degree of correlation between the both antennas, thus giving an effect of excellent space diversity.

Moreover, when the angle between the both antennas is set to 90° so that one essentially receives signals in a horizontally polarized wave surface and the other essentially receives signals in a vertically polarized wave surface, an effect of polarization diversity can also be obtained.

In the seventh embodiment, conductors 733 and 743 are arranged in parallel to substrate 71. However, the present invention is not necessarily limited to this arrangement.

In addition, it is possible to form conductors 734 and 744 on the lowermost layer of the substrate, place a ground plane on the next layer and couple conductors 734 and 744 to the ground plane via high-frequency waves. Although both antennas 73 and 74 are ungrounded in this embodiment, the device may be structured to have one grounded antenna.

(Eighth Embodiment)

Figure 11A:
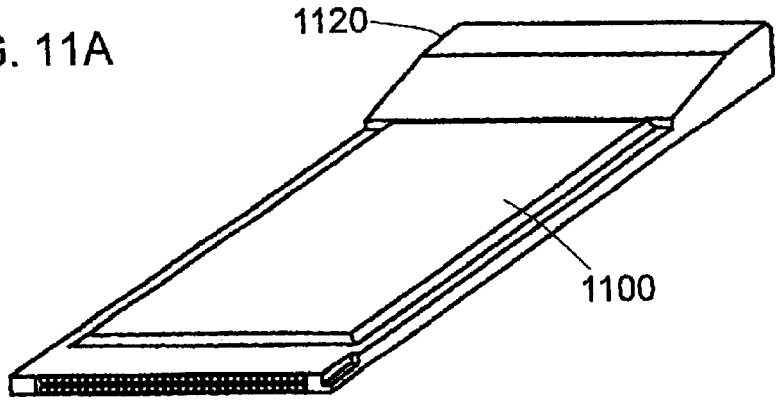
FIG. 11A is a perspective view illustrating an appearance of a wireless PC card as a wireless terminal unit in accordance with an eighth exemplary embodiment of the present invention.
Figure 11B:
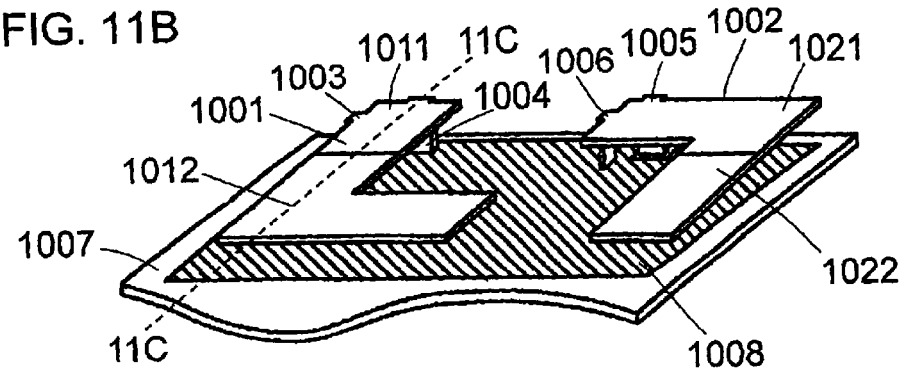
FIG. 11B is a perspective view illustrating the antenna arrangement part on the same PC card in FIG. 11A.
Figure 11C:
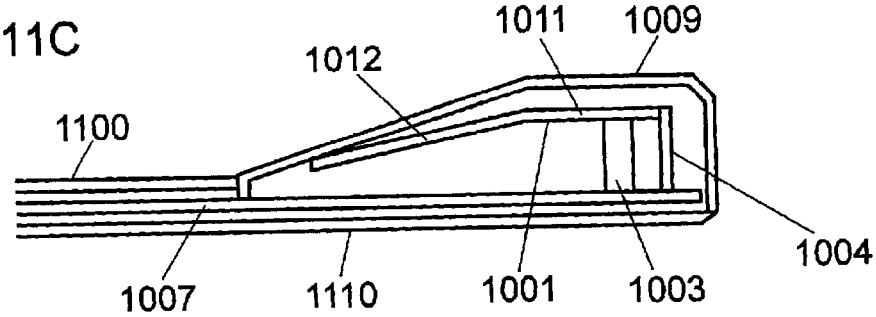
FIG. 11C is a cross-sectional view of the device including its enclosure taken on line 11C—11C of FIG. 11B.

FIG. 11A is a perspective view illustrating an appearance of a wireless PC card as a wireless terminal unit in accordance with the eighth embodiment of the present invention. FIG. 11B is a perspective view illustrating an antenna arrangement part of the PC card. FIG. 11C is a cross-sectional view of the card including its enclosure taken on line 11C—11C of FIG. 11B.

As shown in FIGS. 11B and 11C, the PC card of the eighth embodiment has circuit board 1007 having first antenna element 1001, second antenna element 1002, and ground plane 1008.

Antenna element 1001 has first conductor section 1011 made of such materials as a sheet metal, and second conductor section 1012 made of such materials as a sheet metal bent at an obtuse angle from conductor section 1011 and successively formed therefrom. Bent at and protruding from the edges of conductor section 1011 are feed terminal 1003 and ground terminal 1004 for the antenna element. Similarly, antenna element 1002 has first conductor section 1021 made of such materials as a sheet metal, and second conductor section 1022 made of such materials as a sheet metal bent at an obtuse angle from conductor section 1021 and successively formed therefrom. Bent at and protruding from the edges of conductor section 1021 are feed terminal 1005 and ground terminal 1006. Conductor section 1012 is inclined toward its end face away from feed terminal 1003 of conductor section 1011(see FIG. 11C). The inclination is such that the space between conductor section 1012 and substrate 1007 gradually reduces toward the above-mentioned end face. Similarly, conductor section 1022 is inclined toward its end face away from feed terminal 1005 of conductor section 1021. Antenna elements 1001 and 1002 are grounded to ground plane 1008 on substrate 1007 via terminals 1004 and 1006, respectively, and act as inverted F-type antennas.

The structure of the PC card is further detailed below.

Conductor section 1011 of antenna element 1001 and conductor section 1021 of antenna element 1002 are maintained in parallel to the face of substrate 1007 and are also widely spaced therefrom by feed terminals 1003 and 1005, respectively. In addition, conductor sections 1012 and 1022 are angularly arranged relative to substrate 1007. Then, the entire part including both antenna elements 1001 and 1002 is covered with frame 1009, an armor, to form extended part 1120. Provided over substrate 1007 on both sides are top sheet metal cover 1100 and bottom sheet metal cover 1110, respectively.

By providing both antenna elements 1001 and 1002 in the above-mentioned manner, extended part 1120 of the card can be designed to a shape with a ramp along the both antenna elements instead of a simple box type. This allows the shape of extended part 1120 to be made substantially smaller.

Figure 14A:
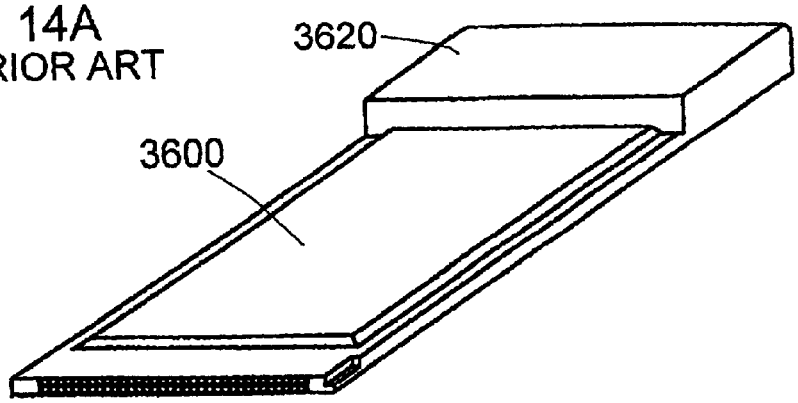
FIG. 14A PRIOR ART
FIG. 14A is a perspective view illustrating an appearance of a wireless PC card as a conventional wireless terminal unit.
Figure 14B:
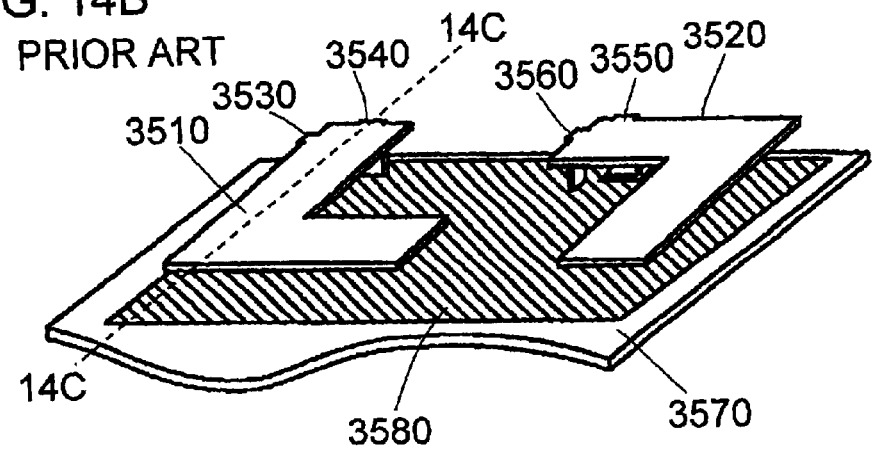
FIG. 14B PRIOR ART
FIG. 14B is a perspective view illustrating the antenna arrangement part on the same PC card in FIG. 14A.
Figure 14C:
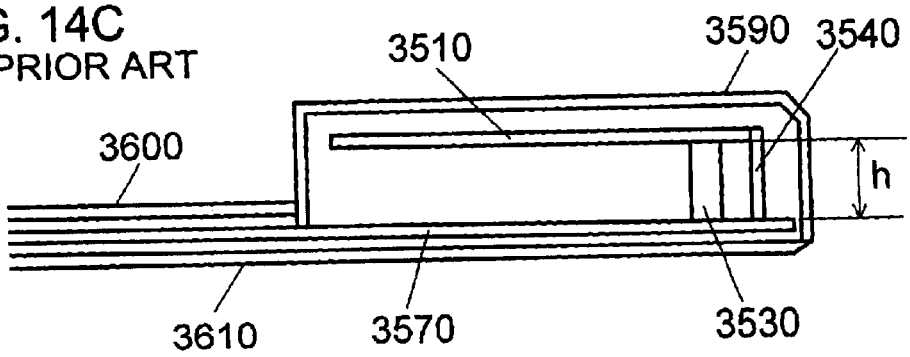
FIG. 14C PRIOR ART
FIG. 14C is a cross-sectional view of the same card including its enclosure taken on line 14C—14C of FIG. 14B.
Figure 15:
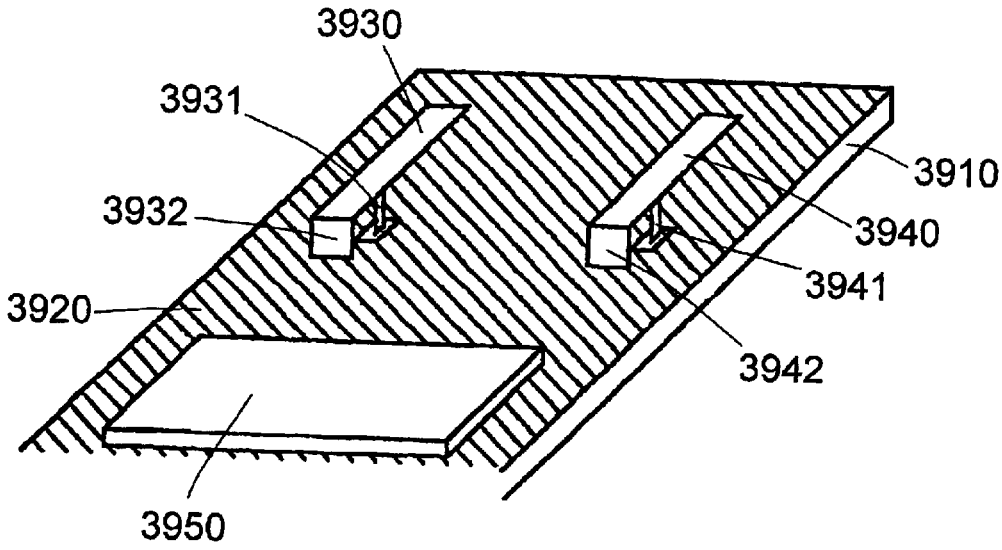
FIG. 15 PRIOR ART
FIG. 15 shows a structure of a conventional diversity wireless device.

Now, comparison of the gain characteristics of the antenna elements is made between this embodiment and conventional examples. The shape of antenna element 1002 shown in FIG. 11B is described below. The space between conductor section 1021 of antenna element 1002 and substrate 1007 is set to 5.5 mm. A portion 5 mm spaced from the tip of conductor section 1022 is inclined at an angle of 20° relative to substrate 1007. For the conventional example shown in FIG. 14B, the space between antenna element 3520 and substrate 3570 is set to 3 mm and 5.5 mm. Then, antenna gains were measured in the case of this embodiment and in the above-mentioned two cases of the conventional example. The measurement was performed in a shield room. A standard hone antenna transmitted continuous waves at a frequency of 2.4 GHz, and antenna elements to be measured received the waves. While the antenna elements were rotated 360°, their gain characteristics were measured with a spectrum analyzer. The average of the measurements was obtained as the results shown in Table 1.

TABLE 1

| | Space between antenna element and substrate [mm] | Antenna gain [dBi] |
|---|---|---|
| This embodiment | 5.5 | −3.92 |
| Conventional example (1) | 3.0 | −7.83 |
| Conventional example (2) | 5.5 | −3.41 |

In comparison of the two conventional examples, increase in the space "h" between the antenna element and the substrate has improved the gain characteristics of the antenna element by approx. 4.4 dB. However, for the PC card in accordance with the conventional example (2), a large extended part cannot be helped.

On the other hand, in comparison with the conventional example (1), the performance of the PC card of this embodiment is better by approx. 3.9 dB. Furthermore, although the PC card of this embodiment is slightly inferior to that of the conventional example (2) in point of gains, the extended part of this embodiment can be shaped smaller by providing a ramp conforming to the shape of the antenna elements.

As described above, the structure of this eighth embodiment is effective in ensuring the performance of the antenna elements and shaping the extended part substantially smaller.

In this eighth embodiment, the invention is described using two inverted F-type antennas as an example. However, the shapes and types of the antenna elements are not limited to the above and other types of antenna elements can be used in combination. In addition, the wireless terminal unit is not limited to a wireless PC card.

(Ninth Embodiment)

Figure 12:
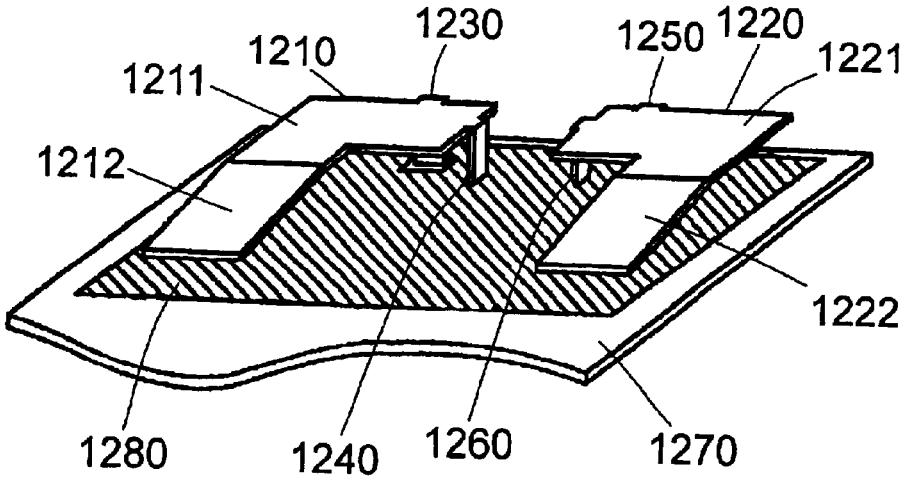
FIG. 12 is a perspective view of an antenna arrangement part on a wireless PC card in accordance with a ninth exemplary embodiment of the present invention.

FIG. 12 is a perspective view illustrating the antenna arrangement part of a wireless PC card in accordance with the ninth embodiment of the present invention.

As shown in FIGS. 12, the PC card of the ninth embodiment has circuit board 1270 having first antenna element 1210, second antenna element 1220, and ground plane 1280.

Antenna element 1210 has first conductor section 1211 made of such materials as a sheet metal, and second conductor section 1212 made of such materials as a sheet metal bent at an obtuse angle from the first conductor section and successively formed therefrom. Bent at and protruding from the edges of conductor section 1211 are feed terminal 1230 and ground terminal 1240 for the antenna element. Similarly, antenna element 1220 has first conductor section 1221 made of such materials as a sheet metal, and second conductor section 1222 made of such materials as a sheet metal bent at an obtuse angle from the first conductor section and successively formed therefrom. Bent at and protruding from the edges of conductor section 1221 are feed terminal 1250 and ground terminal 1260. Antenna elements 1210 and 1220 are grounded to ground plane 1280 on substrate 1270 via terminals 1240 and 1260, respectively, and act as inverted F-type antennas.

In addition, conductor sections 1211 and 1221 are maintained in parallel to the face of substrate 1270 and also widely spaced therefrom by terminals 1230 and 1250, respectively. Conductor sections 1212 and 1222 are angularly arranged relative to substrate 1270, respectively.

The feature of the ninth embodiment is the laterally symmetrical arrangement of antenna elements 1210 and 1220 with respect to the longitudinal axis of the PC card.

The above arrangement of the ninth embodiment makes the gain characteristics of the two antenna elements equal and their directivity substantially laterally symmetrical, thus allowing efficient diversity reception.

In the ninth embodiment, providing a slight size difference between the right and left antenna elements allows correction of the displacement of matching points in the operating frequencies of the antenna elements caused by such influences as the layout of peripheral devices. The correction method can be selected among various ones. For example, conductor section 1212 can be made longer than conductor section 1222.

In this ninth embodiment, the invention is described using two inverted F-type antennas as an example. However, the shapes and types of the antenna elements are not limited to the above. In addition, the wireless terminal unit is not limited to a wireless PC card.

(Tenth Embodiment)

Figure 13:
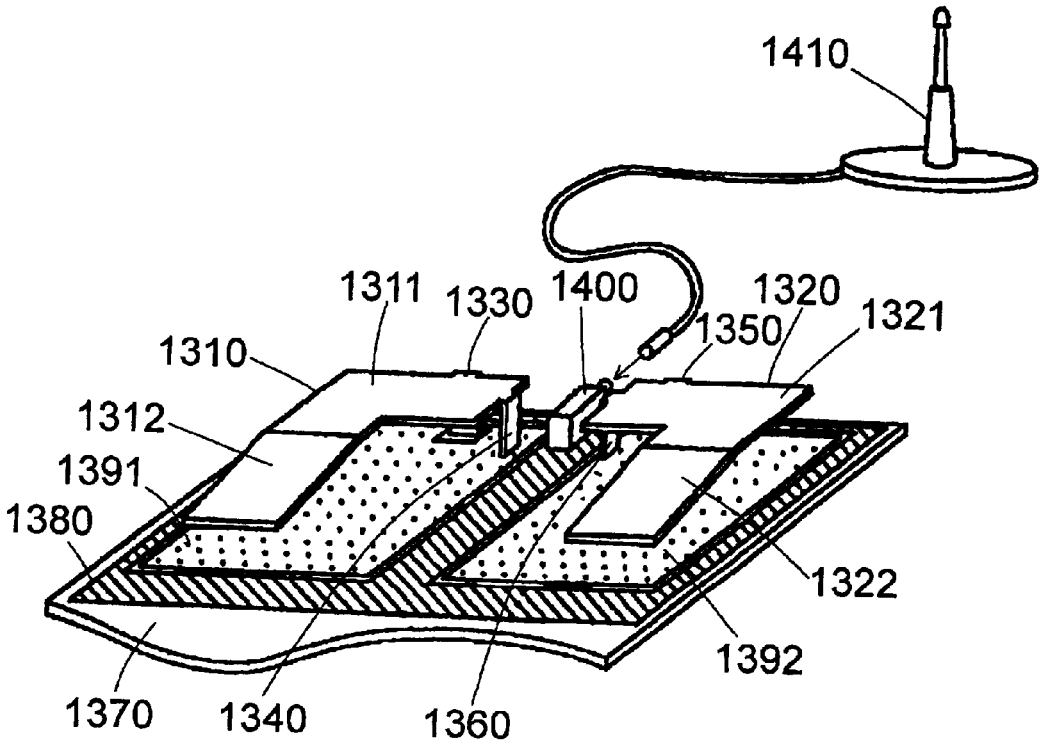
FIG. 13 is a perspective view of an antenna arrangement part on a wireless PC card in accordance with a tenth exemplary embodiment the present invention.

FIG. 13 is a perspective view illustrating the antenna arrangement part of a wireless PC card in accordance with the tenth embodiment of the present invention.

As shown in FIG. 13, the PC card of the tenth embodiment has first antenna element 1310, second antenna element 1320, and circuit board 1370 having ground plane 1380.

Antenna element 1310 has first conductor section 1311 made of such materials as a sheet metal, and second conductor section 1312 made of such materials as a sheet metal bent at an obtuse angle from the first conductor section and successively formed therefrom. Bent at and protruding from the edges of conductor section 1311 are feed terminal 1330 and support terminal 1340. Similarly, antenna element 1320 has first conductor section 1321 made of such materials as a sheet metal, and second conductor section 1322 made of such materials as a sheet metal bent at an obtuse angle from the first conductor section and successively formed therefrom. Bent at and protruding from the edges of conductor section 1321 are feed terminal 1350 and support terminal 1360. Support terminals 1340 and 1360 are both ungrounded.

In substrate 1370, third conductor sections 1391 and 1392 are formed on the top face of ground plane 1380 electrically insulated therefrom. Ungrounded antenna elements 1310 and 1320 are coupled to conductor sections 1391 and 1392, respectively, via high-frequency waves. Conductor sections 1391 and 1392, in turn, are structured as a part of conductor sections of antenna elements 1310 and 1320, respectively.

Conductor sections 1311 and 1321 are maintained in parallel to the face of substrate 1370 and also widely spaced therefrom by terminals 1330 and 1350, respectively. In addition, conductor sections 1312 and 1322 are angularly arranged relative to substrate 1370, respectively. Substrate 1370 is also provided with connector 1400 having a switch, and external antenna 1410 can be connected to the connector, if required.

The feature of the tenth embodiment is that the both antenna elements 1310 and 1320 are ungrounded. This arrangement maintains a lower correlation between the both antennas. Furthermore, placing ground plane 1380 in close proximity to the both antenna elements and coupling the ground plane to the elements via high-frequency waves allows respective antennas to have wider directivity, thus giving an excellent diversity effect.

In the tenth embodiment, the ground plane to be coupled to the both antenna elements via high-frequency waves is formed on the front face of substrate 1370. The ground plane, however, can be formed on the inner layer or the back face of a multi-layer substrate.

The card of the tenth embodiment has connector 1400. When external antenna 1410 is connected to connector 1400, internal second antenna element 1320 is switched to the external antenna 1410 to provide diversity using external antenna 1410 and first antenna element 1310.

Desirably, connector 1400 is placed between two antenna elements depending on the layout of circuit elements; however, that position is not specifically designated.

In this tenth embodiment, the invention is described using two inverted F-type antennas as an example. However, the shapes and types of the antenna elements are not limited to the above. In addition, the wireless terminal unit is not limited to a wireless PC card.

What is claimed is:

1. A diversity wireless device for providing diversity using a plurality of antennas comprising:

a substrate;

a ground plane disposed on said substrate;

at least one grounded antenna by being disposed on said ground plane;

at least one ungrounded antenna disposed on said substrate, said ungrounded antenna isolated from said grounded antenna and isolated from said ground plane, whereby said grounded antenna and said ungrounded antenna provide a diversity gain relative to signals received by said diversity wireless device.

2. The diversity wireless device as described in claim 1 wherein said ground plane is placed in proximity to said ungrounded antenna and said ungrounded antenna communicates with said ground plane via high-frequency waves.

3. The diversity wireless device as described in claim 1 wherein an angle between said grounded antenna and said ungrounded antenna is established at 90°.

4. The diversity wireless device as described in claim 2 wherein an angle between said grounded antenna and said ungrounded antenna is established at 90°.

5. A diversity wireless device for providing diversity using a plurality of antennas wherein a ground plane is disposed on a substrate;

at least one ungrounded antenna is provided and is isolated from said ground plane, said ground plane is placed partly surrounding said ungrounded antenna, and said ungrounded antenna and said ground plane communicate with each other via high-frequency waves;

wherein said ground plane is composed of a plurality of laminated layers and is placed so as to partly surround said ungrounded antenna three-dimensionally, and said ungrounded antenna and said ground plane communicate with each other via high-frequency waves.

6. A wireless terminal unit having first and second antenna elements, each of said antenna elements including:

(a) a substrate;

(b) a ground plane disposed on said substrate;

(c) a first conductor section substantially in parallel to said substrate; and (d) a second conductor section successively formed from said first conductor section and angularly arranged relative to said substrate, wherein at least one of said first conductor section and said second conductor section is isolated from said ground plane.

7. The wireless terminal unit as described in claim 6 wherein said first conductor section has a feed terminal; and said second conductor section is structured so as to be inclined in the direction away from said feed terminal, said inclination being such that the space between said second conductor section and said substrate reduces in the direction away from said feed terminal.

8. The wireless terminal unit as described in claim 7 wherein said unit is structured to have two said antenna elements and provide diversity using said two antenna elements, and said elements are configured substantially laterally symmetrical with respect to a longitudinal axis of the unit.

9. The wireless terminal unit as described in claim 7 comprising:

at least a first and a second said antenna elements provided in said unit and a connector with a switch for connecting to an external antenna wherein said unit is structured so as to switch said first of said antenna elements in said unit to said external antenna and to provide diversity using said external antenna and said second antenna element when said external antenna is connected to said connector.

10. The wireless terminal unit as described in claim 8 wherein said antenna elements are ungrounded, the ground plane is placed in proximity to at least one of said ungrounded antenna elements, and said ungrounded antenna communicates with said ground plane via high-frequency waves.

11. The wireless terminal unit as described in claim 9 wherein said antenna elements are ungrounded, the ground plane is placed in proximity to at least one of said ungrounded antenna elements, and said ungrounded antenna communicates with said ground plane via high-frequency waves.

* * * * *